US012650225B2

(12) United States Patent
DeYoung et al.

(10) Patent No.: US 12,650,225 B2
(45) Date of Patent: Jun. 9, 2026

(54) NOZZLE CONFIGURED TO DELIVER GAS INTO INCINERATOR

(71) Applicant: MARTIN GmbH fur Umwelt- und Energietechnik, Munich (DE)

(72) Inventors: Stefan DeYoung, Munich (DE); Johannes Ulrich Martin, Munich (DE); Max Josef Schonsteiner, Munich (DE)

(73) Assignee: MARTIN GMBH FUR UMWELT-UND ENERGIETECHNIK, Munich (DE)

( * ) Notice: Subject to any disclaimer, the term of this patent is extended or adjusted under 35 U.S.C. 154(b) by 1003 days.

(21) Appl. No.: 17/736,599

(22) Filed: May 4, 2022

(65) Prior Publication Data

US 2022/0364725 A1 Nov. 17, 2022

(30) Foreign Application Priority Data

May 12, 2021 (DE) ..... 102021002508.3

(51) Int. Cl.
*F23L 9/04* (2006.01)
*F23C 7/00* (2006.01)
*F23G 5/44* (2006.01)

(52) U.S. Cl.
CPC ..... *F23L 9/04* (2013.01); *F23C 7/004* (2013.01); *F23G 5/44* (2013.01)

(58) Field of Classification Search
None
See application file for complete search history.

(56) References Cited

U.S. PATENT DOCUMENTS

| | | | | | |
|---|---|---|---|---|---|
| 2,271,587 | A * | 2/1942 | Haynes | F23C 7/006 | 137/601.07 |
| 4,089,637 | A * | 5/1978 | Smith | F23C 7/02 | 239/406 |
| 4,681,532 | A * | 7/1987 | Chung | F23C 7/008 | 239/405 |
| 5,161,946 | A * | 11/1992 | Bortz | F23C 7/004 | 415/208.1 |
| 5,415,539 | A * | 5/1995 | Musil | F23C 7/004 | 239/404 |
| 5,727,480 | A | 3/1998 | Garcia-Mallol | | |
| 10,591,170 | B2 | 3/2020 | Lee et al. | | |

(Continued)

FOREIGN PATENT DOCUMENTS

| | | |
|---|---|---|
| CN | 110848693 A | 2/2020 |
| DE | 197 35345 A1 | 2/1999 |

(Continued)

*Primary Examiner* — David J Laux
(74) *Attorney, Agent, or Firm* — Ralph E. Jocke; WALKER & JOCKE

(57) ABSTRACT

A nozzle (1) is configured to deliver gas into an incinerator such as a waste incinerator (3). The nozzle includes a nozzle pipe (20) and a swirl generator (21). The swirl generator includes a plurality of angularly spaced vanes (24) that are attached to an inner surface (19) of the pipe. The vanes terminate radially inwardly at respective vane inner surfaces (36). A continuous central passage (25) extends axially between the vane inner surfaces. Utilization of the swirl nozzles in connection with an incinerator provide improved gas mixing and avoid having regions with insufficient air to achieve complete combustion.

20 Claims, 5 Drawing Sheets

(56) References Cited

U.S. PATENT DOCUMENTS

| | | | | |
|---|---|---|---|---|
| 2006/0115779 | A1* | 6/2006 | Yamamoto | F23L 9/04 431/115 |
| 2012/0174838 | A1* | 7/2012 | Cameron | F23C 6/045 110/297 |
| 2016/0195266 | A1* | 7/2016 | Kim | F23C 7/004 239/406 |
| 2016/0258685 | A1 | 9/2016 | Wesley et al. | |
| 2023/0129890 | A1* | 4/2023 | Kimberlin | F23L 9/00 110/313 |

FOREIGN PATENT DOCUMENTS

| | | | |
|---|---|---|---|
| DE | 196 13 777 | C2 | 1/2002 |
| DE | 102007030269 | A1 | 1/2009 |
| EP | 0611 919 | A1 | 1/1994 |
| EP | 3 663 647 | A1 | 6/2020 |
| EP | 3739264 | A1 | 11/2022 |
| GB | 2551166 | A | 12/2017 |
| WO | WO2005078348 | A1 | 8/2005 |
| WO | WO 2011/157458 | A1 | 12/2011 |
| WO | WO 2012/096319 | | 7/2012 |

* cited by examiner

NOZZLE CONFIGURED TO DELIVER GAS INTO INCINERATOR

TECHNICAL FIELD

Exemplary arrangements relate to waste incinerators. Exemplary arrangements further relate to nozzles configured to deliver gas into an incinerator in a manner that causes the gas to flow within the incinerator rotationally relative to a longitudinally extending axis of the nozzle.

BACKGROUND

Waste incineration plants utilize secondary air nozzles to facilitate incineration. The secondary air nozzles generally are blast nozzles. Blast nozzles deliver gas from a nozzle outlet generally in a linearly straight direction. The primary design parameters for blast nozzles are the gas pressure and the nozzle diameter. Pressure is the most important factor that determines the velocity of the gas that is delivered from the nozzle outlet. The diameter of the nozzle outlet affects the volume flow. The total volume flow of gas is determined by the number of nozzles. In some arrangements the blast nozzles include cast nozzle inserts.

In operation of some waste incineration plants there may be a region where there is insufficient air due to inadequate gas mixing. This condition may often be encountered at a front wall of the incinerator. This condition where insufficient air is present can result in elevated carbon monoxide (CO) and CO peaks, particularly if the combustible material has a high calorific value. Such conditions may also occur for example in situations when there are high calorie combustion materials in waste incineration plants with grate firing.

European Patent EP 0611 919 A1 which is incorporated herein by reference in its entirety, describes a nozzle for feeding a combustion gas, with which a secondary gas jet with induced swirl is generated. The nozzle mixes a region close to a boiler wall and enriches it with oxygen. The quantity of the supplied volume flow is adjusted inside the gas nozzle with a control element. The control element is arranged so as to be slidable axially along the longitudinal axis of the nozzle to selectively partially block the nozzle cross-section. The nozzle is equipped with a displacing device that can be extracted from the nozzle to enable velocity controlled feeding of the secondary gas. Spacer elements in the form of curved guide vanes are configured as swirl plates on the slidable control element, and are guided along the inner wall of the nozzle. However, when nozzles of this design are used, flue gas may reach the control element arranged inside the nozzle cone. Deposits on the swirl plates resulting from contact with the flue gas can impair its mobility.

U.S. Pat. No. 5,727,480 which is incorporated herein by reference in its entirety, describes a nozzle duct which is concentrically surrounded by a further nozzle duct. The flow of air in the interior of the nozzle duct causes gas to be drawn in through the annular passage between the concentric ducts. Guide vanes are provided in the annular passage, which operate to guide the gas flowing through the inner passage from the inner duct to the outer duct, and create a particular gas flow at the nozzle outlet. This nozzle configuration has considerable complexity because two controlled gas feeds must be provided.

International Publication WO 2012/096319 A1 which is incorporated herein by reference in its entirety, also describes concentric pipes for feeding gas in a targeted manner. A swirl plate which is slidable along the longitudinal axis of the nozzle by means of a rod is arranged inside the pipe. However, when this arrangement is used, soiling of the pipes, and particularly of the swirl plate may occur which obstructs the flow of gas.

In some prior arrangements even when two different gas media (for example recirculated flue gas and air) are injected through one blast nozzle, a strong input gas pulse may be useful for effective mixing of the flue gas over as much of the cross-section as possible of a boiling bed within the incinerator which is alternatively referred to herein as a boiler.

However, a challenge which persists is that because of the distance between the blast nozzles, the resulting gas streams from the blast nozzles within the incinerator may still be poorly diffused, particularly in areas close to the walls, resulting in zones in which little mixing occurs. In such situations CO containing exhaust gas is able to pass through the secondary combustion zone and escape to atmosphere.

As a consequence prior nozzles and nozzle arrangements used in connection with waste incinerators may benefit from improvements.

SUMMARY

Exemplary arrangements described herein include a nozzle for waste incinerators which provides a long service life in harsh operating conditions. Exemplary nozzle arrangements further provide greater gas stream diffusion within an incinerator for a given volume nozzle flow and pressure.

Exemplary arrangements include swirl nozzles which produce more pronounced gas stream diffusion for a given gas volume flow and pressure, and consequently reduced gas penetration depth. This is achieved in exemplary arrangements by splitting the gas pulse input into an axial component and a tangential component. In blast nozzles as previously discussed, the entire gas pulse input is directed axially. The use of the exemplary swirl nozzles as secondary air nozzles, may be utilized to reduce air insufficiency within the incinerator in the vicinity of the wall, particularly the front wall of the incinerator. The use of such nozzles and approaches may be particularly useful in waste incineration plants.

The exemplary arrangement includes a nozzle including a nozzle insert with desirable gas injection characteristics. In exemplary arrangements the swirl nozzle may be utilized in an incinerator to provide an "air curtain" close to a boiler wall to prevent tendrils of CO from breaking through. Such approaches may be useful compared to prior arrangements with blast nozzle inserts which provide for the input gas pulse to be made as strong as possible, which was thought to provide more complete mixing of the flue gas while utilizing the minimum amount of supplied combustion air.

Exemplary arrangements of the swirl nozzle include a swirl insert which produces a similar pressure-volume characteristic curve to a conventional blast nozzle, while producing a strong swirl effect. This is achieved in an exemplary arrangement in which the insert includes a pipe which is cylindrical and extends along an axis over the entire length thereof. The inlet of the insert pipe is preferably not simply round. This is because if the pressure loss were too great, the nozzle diameter would have to be increased greatly in order to achieve sufficient volume flows in the conventional pressure range. Higher pressures would require the use of an additional fan and/or compressor to deliver the gas. Such additional required components would have an additional cost.

The exemplary arrangement is operative to create a swirl flow which causes the gas to uniformly flow outward from the nozzle outlet opening as well as to rotationally flow relative to the nozzle axis after having been delivered from the outlet opening. Exemplary arrangements are operative to prevent reverse flows into the nozzle outlet opening, thus avoiding infiltration of hot flue gases and ash particles into the nozzle. Such arrangements avoid soiling and corrosion of the swirl generator structures. In some exemplary arrangements a plurality of angularly spaced vanes are utilized which each have a straight section that extends parallel to the nozzle axis in an inflow area of the nozzle insert. Such vanes further include gas engaging surfaces with curved portions that extend at a swirl angle within the nozzle in closer axial proximity to the nozzle outlet opening.

In exemplary arrangements different configurations may be utilized to produce desirable swirl nozzle gas delivery properties. For example, a diffuser or radius at the nozzle outlet opening may be utilized to reduce pressure loss, although an adjoining flow is only to be expected in combination with a small swirl generator. Further in some arrangements the swirl generator and nozzle are configured to minimize the possibility of reverse flow regions which may increase the risk of soiling and corrosion within the nozzle interior.

In exemplary arrangements a continuous central passage that extends axially through the swirl generator is operative to minimize the risk of the formation of reverse flow regions and to also reduce pressure loss. In exemplary arrangements the swirl vanes which extend radially inward in the interior area from the inner surface of the pipe that bounds the interior area, terminate radially inwardly at vane inner surfaces that are each uniformly disposed a distance away from the axis. Such arrangements provide for the continuous central passage to enable the gas being introduced to more freely flow along the central axis of the swirl generator.

In exemplary arrangements the swirl generator with a plurality of angularly spaced vanes, each of which include straight sections that extend parallel to the axis in the inflow section of the nozzle, is useful in that it reduces pressure loss. The transition to the curved swirl generating portions of the vanes with the gas engaging surfaces that impart rotational flow of the gas about the axis, may have various designs. For example, in some arrangements a radius or curved profile may be utilized. The exemplary swirl generating portion of the vanes may also be curved or extend at an angle transverse to the axial direction. In some exemplary arrangements each vane may be configured such that the height of the vane which corresponds to the radial distance that the vane extends away from the inner surface that bounds the interior area of the swirl generator, increases with proximity to the nozzle outlet opening.

An axial inward offset is provided in exemplary arrangements between the nozzle outlet opening and the swirl generator. Providing for an axial inward offset reduces the risk of soiling and corrosion of the swirl generator structures. In some arrangements the inward offset of the gas engaging vane surfaces which induce the swirling movement of the gas delivered from the nozzle outlet opening, reduces the rotational flow of the gas after it has left the nozzle to a level that is not optimum. In such arrangements, increased rotational flow may be achieved by providing a greater angle of the gas engaging surfaces of the vanes relative to a plane which extends through and includes the axis of the nozzle pipe. Further in other exemplary arrangements the loss of pressure resulting from greater swirl angles may be compensated for by using a larger nozzle diameter and/or a diffuser. Of course these approaches are exemplary and other arrangements other approaches may be used.

In other exemplary arrangements a swirl nozzle may be produced through installation of the exemplary swirl generator in a conically tapered part of a blast nozzle insert. Swirl generation by the introduction of air into the nozzle tangentially through a plurality of inlet channels distributed about the circumference may also be useful in producing the desired rotational flow of the gas that is delivered within the incinerator.

In some exemplary arrangements it is useful if the nozzle pipe is arranged concentrically inside of an outer pipe. In such arrangements a swirl insert consists of the nozzle pipe in which the swirl generator is located. In some exemplary arrangements the nozzle pipe is in welded connection within the outer pipe. Such arrangements provide a nozzle insert which can be inserted into an outer pipe. In exemplary arrangements the nozzle pipe may have a wall thickness of from 2 mm to 5 mm. Also in exemplary arrangements the cylindrical inner surface of the pipe may have an inside diameter perpendicular to the axis of from 40 mm to 80 mm. Some exemplary arrangements may have a inside diameter of about 50 mm.

Some exemplary arrangements may include a swirl generator that includes swirl vane profiles that include gas engaging surfaces that produce a rotational gas movement that extend at an angle relative to a plane that extends through and includes the axis of the swirl nozzle. Such gas engaging surfaces of the vanes may extend at angles of from 15° to 60° relative to such an axial plane. Certain exemplary arrangements may have gas engaging surfaces of the vanes extending at angles from 40° to 50° and in some arrangements 45° relative to such an axial plane for producing the rotational movement of the gas relative to the axis. In exemplary arrangements the rotational flow is increased with larger angles. However, the angular position of the gas engaging surfaces may be varied in exemplary arrangements to avoid undesirable pressure loss and the formation of reverse flow regions.

As previously discussed, in exemplary arrangements the structures of the swirl generator are axially inwardly offset away from the nozzle outlet opening. In exemplary arrangements the swirl generator is inwardly offset from the nozzle outlet opening at least 5 mm and in other arrangements about 10 mm into the pipe interior. Further in exemplary arrangements the swirl generator is disposed at a distance from the boiler of the incinerator of about 10 mm to 30 mm. Of course these approaches are exemplary and in other arrangements other approaches may be used.

In exemplary arrangements the swirl generator has a plurality of angularly spaced swirl vanes that are equally distributed about the circumference thereof. Exemplary arrangements include at least four swirl vanes. Some exemplary arrangements may include between four and eight swirl vanes.

In exemplary arrangements the vanes of the swirl generator have an average vane profile thickness in cross-section in a direction perpendicular to the axis of from 2 mm to 4 mm. Exemplary arrangements provide for the axial length of the vanes parallel to the axis along the axial direction to be in the range of from 20 mm to 60 mm. Exemplary arrangements may have a vane axial length of about 30 mm. In exemplary configurations of the swirl nozzle, the straight sections of the respective vanes which are disposed furthest away from the nozzle outlet opening comprise from 30% to 70% of the total axial length of the vanes. In some exemplary arrangements 50% of the total axial length of the vanes includes the straight sections. Such arrangements are useful in reducing pressure loss through the swirl nozzle.

Further in exemplary arrangements soiling and corrosion of the vanes may be reduced by having a continuous central passage extending between the vane inner surfaces of the swirl vanes. In exemplary arrangements the diameter of the vane central passage is greater than 20% of the diameter of the inner surface of the nozzle pipe. The absence of structures which extend between the vane inner surfaces is useful in preventing the infiltration of contaminants into the nozzle. In some exemplary arrangements the diameter of the continuous central passage in a cross-section perpendicular to the axis, is in the range of from 10 mm to 30 mm, and in some arrangements is 16 mm. Thus in at least some exemplary arrangements it is useful to have the diameter of the continuous central passage be approximately 30% of the inside diameter of the inner surface that bounds the interior area of the pipe.

In some exemplary arrangements the nozzle may provide the capability for varying the degree of swirl that is provided in the gas that is delivered into the incinerator. This may be achieved in some exemplary arrangements by providing a mechanism that provides a mechanically adjustable angle of attack of the vanes of the swirl generator. This may include in some arrangements a swirl generator that includes selectively angularly movable swirl vanes or adjustable swirl vane portions.

Alternatively in other exemplary arrangements the degree of swirl may be selectively achieved by providing two concentric channels with different swirl angles, for example channels that provide a twist free core jet and a twisted annular passage. In exemplary arrangements the gas may be controlled to flow through the concentric channels with a variable volume flow ratio. Thus for example in some arrangements two collectors may be provided each with a collector and a pressure control via a control valve. Such arrangements may be advantageous for a flexible mode of operation and useful in the event of shifts of the combustion zone due to variations of the average calorie value of the waste being incinerated, or variations of the load of the combustion material being incinerated. Such exemplary arrangements enable introducing and mixing different gases such as for example air and recirculated flue gas or alternatively air and steam.

Alternative exemplary arrangements may include providing the nozzle pipe with at least one, and in some arrangements multiple tangential inlet channels that are distributed about its circumference. Alternatively or in addition the nozzle may also include a pipe with one or more gas supply channels including curved spiral gas engaging surfaces distributed about its circumference. Of course numerous different arrangements may be utilized.

In exemplary arrangements the speed of the gas delivered from the nozzle outlet opening is below Mach 0.4.

In some exemplary arrangements swirl nozzles of the exemplary arrangements may be installed in connection with an incinerator wall that bounds a flue gas exhaust. Preferably the swirl nozzle is arranged in the flue gas wall to deliver gas into the flue gas exhaust so as to provide rotational gas flow within the exhaust chamber. In some exemplary arrangements it is advantageous to provide two of the swirl nozzles arranged in side-by-side relation to impart rotational gas flow in opposed rotational directions within the incinerator.

In other exemplary arrangements it is useful to provide a blast nozzle, which delivers gas into the incinerator interior axially and without a swirl, beside a swirl nozzle which delivers gas with rotational flow within the incinerator interior. Of course numerous different arrangements may be utilized depending on the incinerator configuration and operating conditions.

Exemplary arrangements of the described swirl nozzle configuration may be utilized in connection with methods in which gases such as air or oxygen, which provide oxygen enrichment, are delivered adjacent to a wall such as a front wall of an incinerator. The incinerator may be an incinerator utilized in a waste incineration plant for example, and the gas may be delivered into the first flue gas exhaust. Such a method is particularly suitable for use with a fuel with a high calorific value, such as a substitute fuel being utilized to increase incineration temperature, and/or in cases of where a grate firing incineration configuration is utilized.

The exemplary nozzles may be used to expand existing combustion air systems in the secondary combustion area of incinerators. When utilized in this context the exemplary swirl nozzles may be utilized to replace individual blast nozzles, or alternatively may be used in combination with such blast nozzles. In some exemplary arrangements adjacent nozzles may be configured to advantageously impart gas flows in opposed rotational directions or in other directions as is necessary to achieve desired combustion properties.

In some exemplary methods of use it is advantageous if the gas volume flow which is passed through the swirl nozzle is adjusted to be in a range of 100 $Nm^3/h$ for each nozzle. In exemplary arrangements this yields operating pressure in the collector of the nozzle plane of about 52 to 100 mbar, and the velocity is in the range of 10 to 100 m/s. In one exemplary arrangement the air volume flow has a value of 100 to 500 $Nm^3/h$ for an operating pressure in the collector of 10 to 60 mbar and an inlet velocity of 20 to 80 m/s. Of course these approaches are exemplary and in other arrangements other approaches may be used.

The exemplary swirl nozzles described herein may also be used for example for delivering air, recirculation gas, steam, carbon dioxide, $O_2$ or $N_2$ and/or mixtures thereof. However, when the gas feed involves recirculation gas, which is usually charged with particles, or steam, heavier soiling and increased corrosion may be expected to occur causing greater nozzle wear.

In some exemplary arrangements swirl nozzles of the types described herein may be manufactured as swirl inserts utilizing additive manufacturing processes such as 3D printing. In such arrangements such inserts may be produced from stainless steel (such as 17-4PH or 1.4548). In other arrangements swirl inserts may be produced by precision casting or CNC machining for example.

In some exemplary arrangements a swirl nozzle can be configured as a swirl insert that is welded into an outer pipe. Alternatively the swirl insert may be produced as a welded construction with plates welded into a pipe for example, as an alternative to 3D printing, precision casting or CNC machining.

In some exemplary applications the risk of soiling and corrosion of the components of the swirl nozzle may be reduced by utilization of rounded vanes, for example, or by including a central lug or tip.

Depending on the particular configuration, the swirl nozzle may also produce a less powerful suction effect than blast nozzles. As a result in some incinerator configurations the use of swirl nozzles may result in less particle deposition on the corresponding walls adjacent to the boiler.

Further features of exemplary arrangements are discussed in the following detailed description.

DETAILED DESCRIPTION

Figure 1:
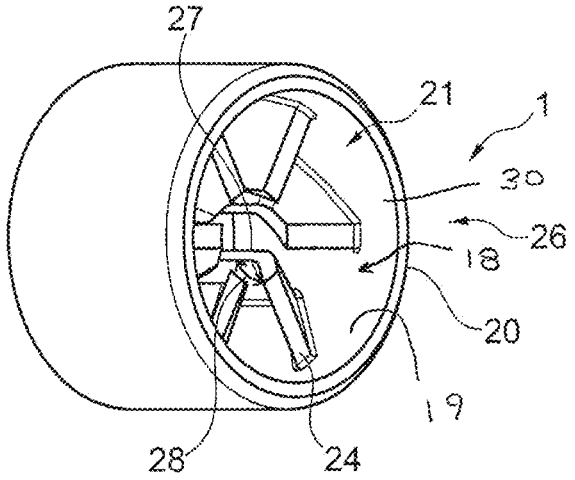
FIG. 1 is a front right perspective view of a swirl nozzle including a pipe with a swirl generator.

Referring now to the drawings and particularly to FIG. 1 there is shown therein a swirl nozzle generally indicated 1. The exemplary swirl nozzle is configured to be used as a swirl insert 26 in an outer pipe as later discussed. Of course it should be understood that this configuration is exemplary.

The exemplary swirl nozzle 1 includes a cylindrical pipe 20. The exemplary pipe 20 includes a cylindrical inner surface 19. The cylindrical inner surface bounds an interior area 18 of the nozzle. The nozzle pipe 20 extends along an axis 17 and terminates in a nozzle outlet opening 30. In the exemplary arrangement the cylindrical inner surface 19 has a diameter perpendicular to the axis 17 of from 40 mm to 80 mm.

Within the interior area 18 of the pipe 20 is a swirl generator 21. In the exemplary arrangement the swirl generator comprises a structure with at least one gas engaging surface that causes gas flowing through the nozzle toward the nozzle outlet opening 30 to flow rotationally about the axis 17 after being delivered from the outlet opening. In the exemplary arrangement the swirl generator includes six swirl vanes 24. The exemplary swirl vanes extend radially inward from the inner surface 19 and each terminate at a vane inner surface 36. Each vane inner surface is disposed a fixed distance radially away from the axis 17.

In the exemplary arrangement each of the swirl vanes 24 are angularly spaced away from each of the other swirl vanes. The exemplary swirl vanes 24 are equally angularly spaced about the inner surface 19. The vanes each extend an axial length along the axial direction within the pipe 20. Each of the vanes include a straight section 27 that is disposed furthest away from the nozzle outlet opening at an inflow end of the nozzle. The straight inflow section 27 of each vane extends parallel to and in centered relation with a plane that extends through and includes the axis 17. Near an end of each vane 24 and adjacent to the nozzle outlet opening, each vane includes a turned gas engaging surface 37 that is turned to be somewhat transverse to the plane through and which includes the axis with which the straight section 27 of the respective vane is aligned. The vane and the gas engaging surface of each swirl vane is turned at a swirl angle 28 relative to the plane. In exemplary arrangements the swirl angle extends between 20° and 45°. Of course this arrangement is exemplary and in other arrangements other configurations may be used.

In the exemplary arrangement the swirl vanes extend along the axial direction parallel to the axis a total axial length distance of from 20 mm to 60 mm. In exemplary arrangements the straight sections comprise from 30% to 70% of the total axial length. The exemplary vanes have a thickness in a cross-section perpendicular to the axis 17 of from 1 to 6 mm. Of course it should be understood that this arrangement is exemplary and in other arrangements other configurations may be used.

In the exemplary arrangement each of the swirl vanes 24 are axially set back from the nozzle outlet opening 30. In the exemplary arrangement the outer end faces 38 of the swirl vanes 24 are set back an axial distance of at least 5 mm. This is done in the exemplary arrangement to minimize the effects of corrosion which may occur as a result of contact with flue gas or other contaminants within the incinerator.

A continuous central passage 25 extends along the axis 17 between the vane inner surfaces 36 of the swirl vanes 24. As previously discussed, in some exemplary arrangements of the swirl nozzle the vane inner surfaces 36 may be positioned away from the inner surface 19 of the pipe 20 a radial distance that is continuous along the entire length of the vane. In other exemplary arrangements the radial height of the vane from the inner surface 19 to the vane inner surfaces 36 may vary along the axis depending on the flow properties desired. In exemplary arrangements the diameter of the continuous central passage 25 is at least 20% of the inside diameter of the inner surface 19 of the pipe 20. In some exemplary arrangements this corresponds to a diametric distance of from 10 mm to 30 mm. In some exemplary arrangements the continuous central passage 25 is 30% of the inside diameter of the inner surface. Of course these configurations are exemplary and in other arrangements other configurations may be used.

Figure 2:
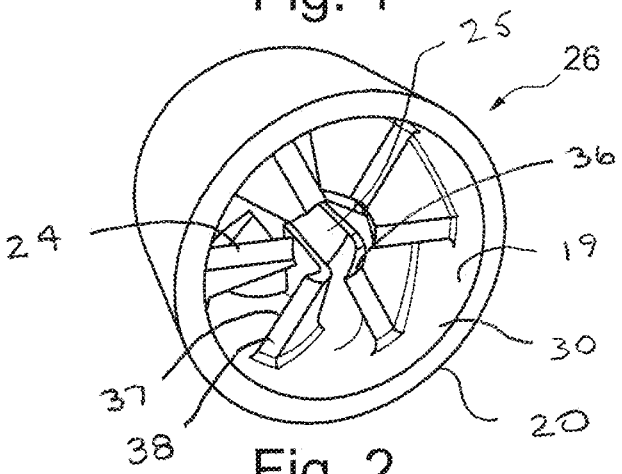
FIG. 2 is a front top right perspective view of the swirl nozzle that shows the internal area and swirl vanes.

While in the exemplary arrangement of the nozzle 1 shown in FIGS. 1 and 2 the straight portions and angled portions of each vane are in fixed connection with the inner surface 19 of the pipe, in other arrangements other approaches may be utilized. For example as schematically represented in the central panel of FIG. 10, in other exemplary arrangements the angled portions of the vanes may be made angularly movable relative to a plane that extends through and includes the axis. This may be done by separating the root portion at the radially outer portion of each swirl vane from the inner surface to provide for rotational movement thereof. Such rotational movement may be achieved through a rotational adjustment mechanism schematically indicated 43. In exemplary arrangements the mounting of the angled portions of the vanes may enable selected vane movement and locking the vanes in selected angled positions so that the gas engaging surfaces thereof are at a suitable angle for producing the desired rotational gas flow about the axis after the gas has left the nozzle outlet opening 30. Of course numerous different approaches for achieving such adjustment capabilities may be used.

Figure 3:
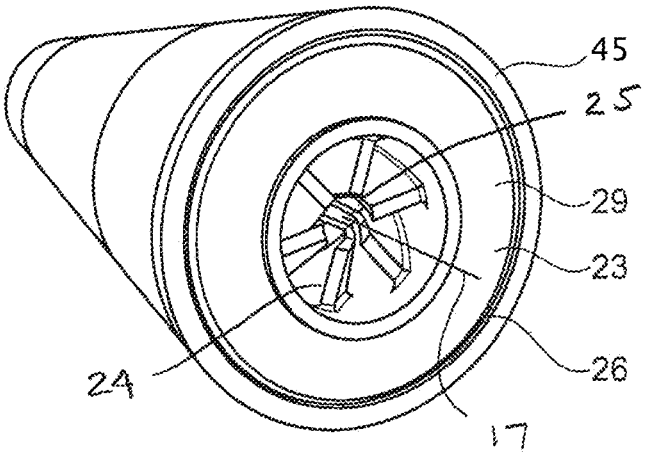
FIG. 3 is a front top right perspective view of the exemplary swirl nozzle configured as a swirl insert in an outer pipe.

FIG. 3 shows an exemplary arrangement in which the nozzle 1 is included in a nozzle pipe 45. This exemplary arrangement includes a swirl insert 26 housed within an outer pipe 23. The outer pipe 23 is housed within a nozzle pipe 45. Of course this arrangement is exemplary and it should be understood that other configurations may be utilized for purposes of housing the exemplary nozzle configurations.

Figure 4:
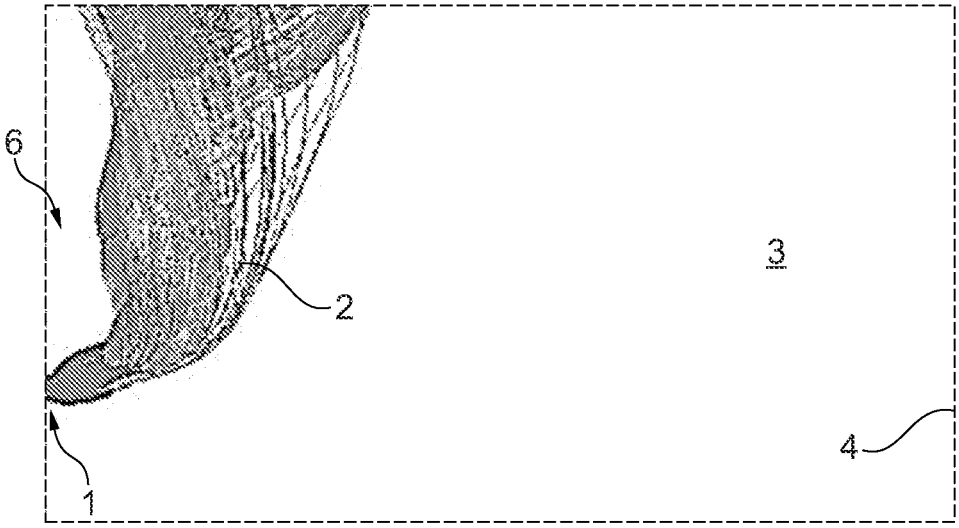
FIG. 4 is a graphic representation of gas flow from the nozzle outlet opening of an exemplary swirl nozzle that delivers gas at a front wall of incinerator.

FIG. 4 is a graphic representation of the gas flow produced by the exemplary swirl nozzle 1 when delivering gas 2 into an incinerator 3. The incinerator 3 is represented schematically as a flue gas exhaust 4. As shown the swirl nozzle delivers the gas into the incinerator with the gas delivered through the nozzle outlet opening initially rotationally moving within the flue gas exhaust about the axis. Of course as shown the gas flow is diverted and diffused in the flue gas exhaust flow upwardly is shown.

Figure 5:
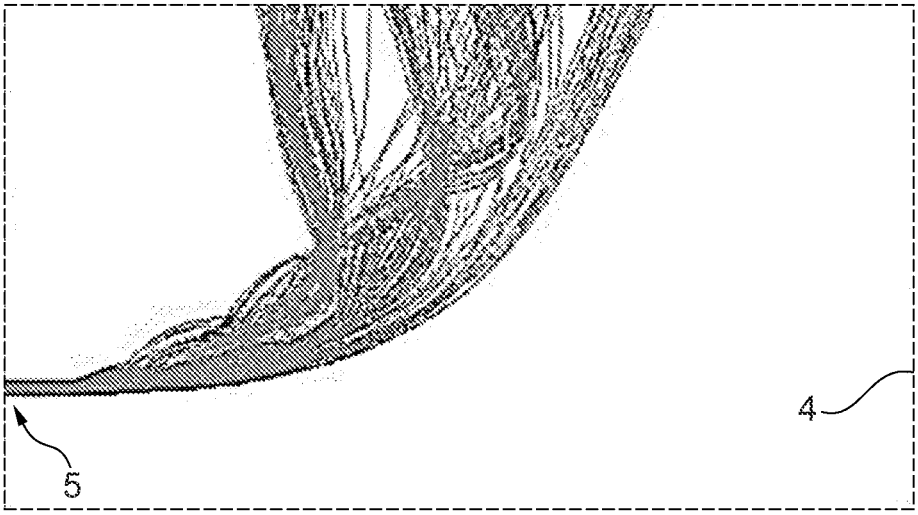
FIG. 5 is a graphic representation of gas flow from a blast nozzle arranged in a similar location as the swirl nozzle shown in FIG. 4 and operated at the same volume flow and pressure.

FIG. 5 is a graphic representation of gas flow delivered by blast nozzle 5 which operates to deliver the same volume flow of gas into the flue gas exhaust as the swirl nozzle shown in FIG. 4. The Figures show that the gas 2 which is delivered through the swirl nozzle in FIG. 4 remains adjacent to the front wall 6 of the flue gas exhaust and does not advance as far into the interior of the flue gas exhaust from the nozzle as the gas from the blast nozzle 5. As shown in FIG. 5 gas delivered from the blast nozzle advances further into the flue gas exhaust 4, and only diffuses at about the middle of the flue gas exhaust at which the gas delivered from the blast nozzle spreads out in a fan pattern upward due to flue gas exhaust flow.

FIGS. 6 through 9 graphically demonstrate a useful aspect that results from the use of the exemplary swirl nozzles described herein. In each of FIGS. 6 through 9 reference numerals 7 and 8 refer to large blast nozzles. These large blast nozzles are arranged on a rear wall 9 of the flue gas exhaust 4. In each of FIGS. 6 and 7, large blast nozzles 10 are arranged at the top of the front wall 6, with a large rear blast nozzle (not shown) below, all of which nozzles deliver gas 2 into the flue gas exhaust 4.

In these exemplary arrangements smaller nozzles are arranged horizontally beside the lower obscured large blast nozzles. These smaller nozzles are comprised in the arrangement of FIG. 6 as a small blast nozzle 11, and in the arrangement of FIG. 7 as a small swirl nozzle 12. In this exemplary arrangement a small nozzle 11, 12 differs from a large nozzle 8, 9 and 10, in that a small nozzle 11, 12 delivers a smaller volume flow of gas into the flue gas exhaust 4.

Figure 6:
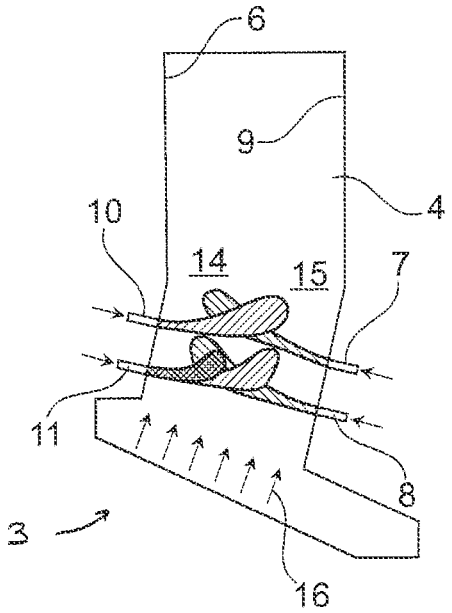
FIG. 6 shows schematically an exemplary flue gas exhaust configuration of incinerator with four blast nozzles and with the blast nozzle at the bottom left as shown configured as a small blast nozzle.
Figure 7:
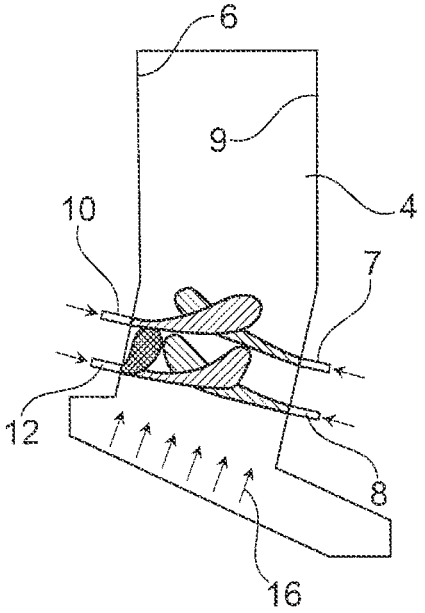
FIG. 7 shows schematically the exemplary flue gas exhaust configuration similar to FIG. 6 but with a swirl nozzle of the exemplary arrangement as a small nozzle at the bottom right as shown.

In the exemplary incinerator 3 as schematically shown, the primary combustion gas 16 is introduced through a grate from below the grate. In this exemplary arrangement as shown in FIG. 6, a region 14 with insufficient air forms in the vicinity of the front wall 6, and a region 15 with excess air forms in the vicinity of the rear wall 9. In contrast, in the arrangement of FIG. 7 which includes the installation of the small swirl nozzle 12, the flue gas exhaust 4 has a more uniform air distribution and improved mixing of the combustion gases and air to provide more complete combustion.

Figure 8:
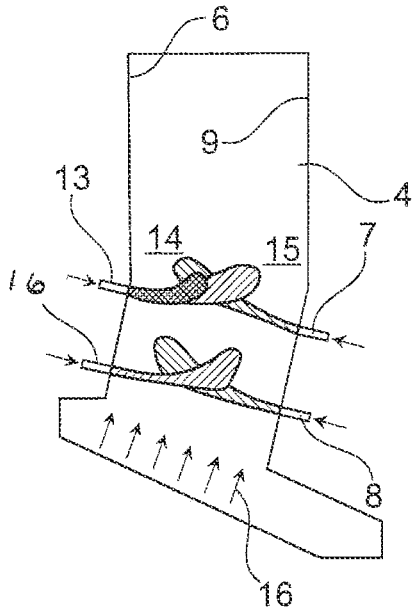
FIG. 8 shows schematically the exemplary flue gas exhaust configuration similar to FIG. 6 but with a small blast nozzle at the top left as shown.
Figure 9:
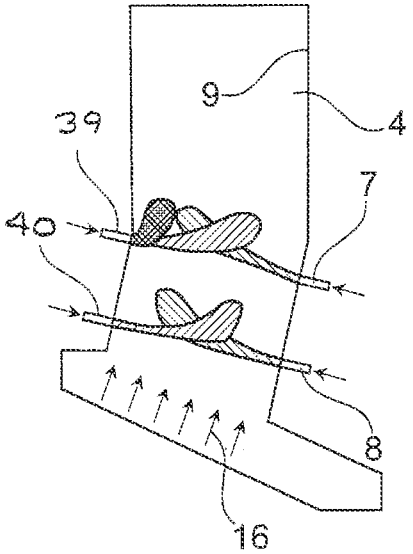
FIG. 9 shows schematically the exemplary flue gas exhaust configuration similar to FIG. 6 but with a swirl nozzle of the exemplary arrangement as a small nozzle at the top right as shown.

The effects that result are similar when smaller nozzles 13 and 39 are arranged horizontally beside the upper, obscured, large blast nozzles 10 as shown in FIGS. 8 and 9. In the exemplary arrangement shown in FIG. 8, the smaller nozzle 13 comprises a small blast nozzle 13. In the exemplary arrangement shown in FIG. 9 the nozzle 39 comprises a small swirl nozzle. Large blast nozzles 16 and 40 are arranged below the small nozzles in each case. This configuration leads to the result that in FIG. 8 a region 14 with insufficient air forms on the front wall 6 while a region 15 with excess air forms in the vicinity of the rear wall 9. However, as shown in FIG. 9 the installation of the small swirl nozzle 39 and the delivery of gas therefrom into the flue gas exhaust 4 provides a more uniform air distribution and improved mixing of the combustion gases and air.

Figure 10:
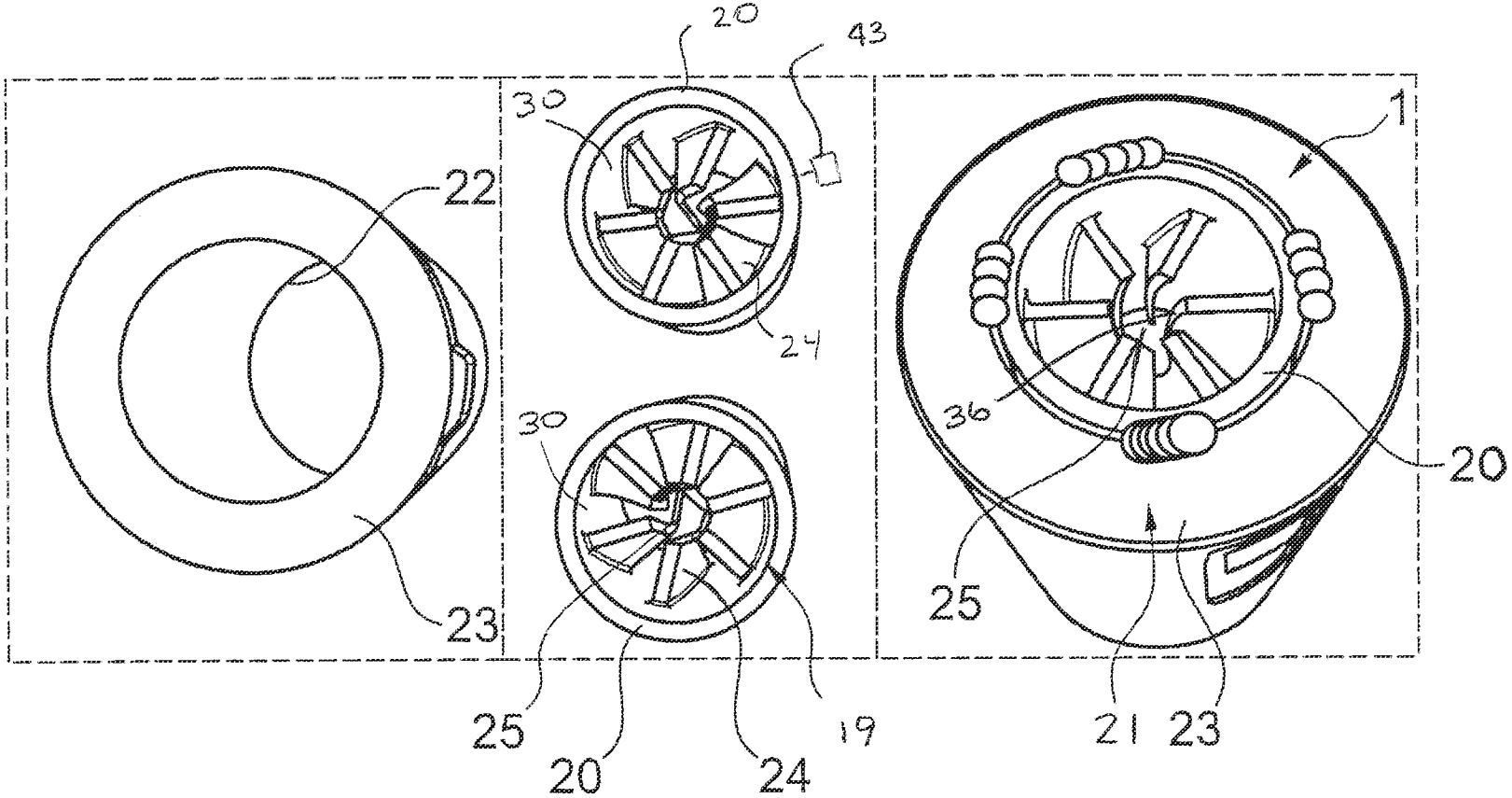
FIG. 10 shows in a left panel a front left perspective view of an outer pipe of a nozzle, in a central panel perspective views of swirl inserts each including the pipe and swirl generator thereof, and in a right panel a nozzle insert that includes an outer pipe with a welded swirl insert therein.

FIG. 10 shows the components of an exemplary nozzle assembly including the outer pipe 23. The nozzle 1 is configured as a swirl insert 26 including the cylindrical pipe 20 and the swirl generator 21 located therein in the arrangement previously discussed. In this exemplary arrangement the pipe 20 is welded to an inner side 22 of the outer pipe 23. The exemplary swirl insert 26 in this arrangement includes the pipe 20 with the swirl vanes 24 attached to the inner surface 19 thereof. As previously mentioned in some arrangements the angles of the swirl vanes adjacent to the nozzle outlet opening 30 may be made movably adjustable through use of the mechanism 43. Further the continuous central passage 25 is shown extending along the axis 17 in intermediate radial relation of the vane inner surfaces 36. As previously discussed, as the continuous central passage 25 does not include any structures therein the flow of the gas therethrough is substantially unimpeded to reduce the risk of infiltrating contaminants corroding the swirl generating structures and reducing pressure drop. Of course it should be understood that the structures of the swirl generator 21 shown are exemplary and in other arrangements other structures and configurations may be utilized.

Figure 11:
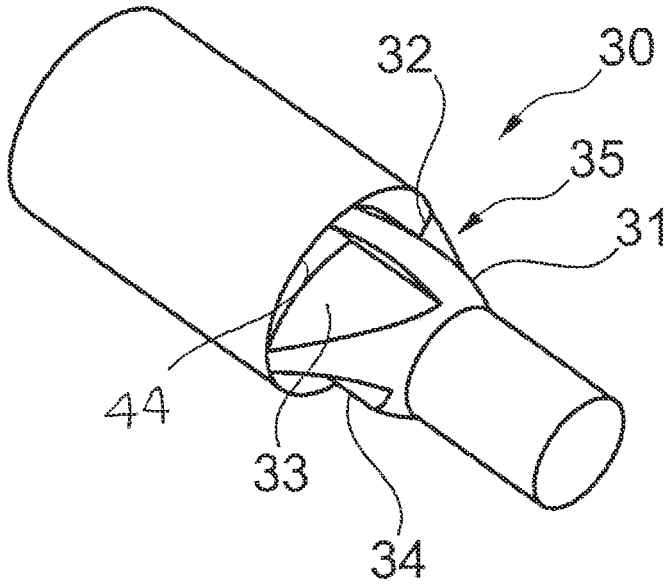
FIG. 11 is a back top right perspective view of an alternative swirl nozzle which is operative to provide swirl generation by radial and tangential in flow of gas in a conical region of the nozzle.

FIG. 11 shows an alternative nozzle 30. The exemplary nozzle 30 includes a nozzle pipe 31. A nozzle pipe includes an inner surface 44. Inlet channels 32, 33 and 34 are angularly distributed about the circumference of the nozzle pipe. The exemplary inlet channels are distributed evenly over a circumference in a conical region 35 of the nozzle pipe 31. The inlet channels extend tangentially and radially relative to the inner surface 44 and are bounded by angled gas engaging surfaces. The exemplary inlet channels enable further gas to be supplied through the inlet channels in addition to the gas delivered in the nozzle pipe 31. This exemplary configuration is operative to cause rotational gas movement within the nozzle 30 and to cause rotational gas movement about a central axis of the nozzle after gas is delivered from the nozzle outlet. Thus in this exemplary nozzle arrangement the inlet channels 32, 33 and 34 along with the conical structure and gas engaging surfaces comprise a swirl generator which is attached to the inner surface of the nozzle pipe.

Figure 12:
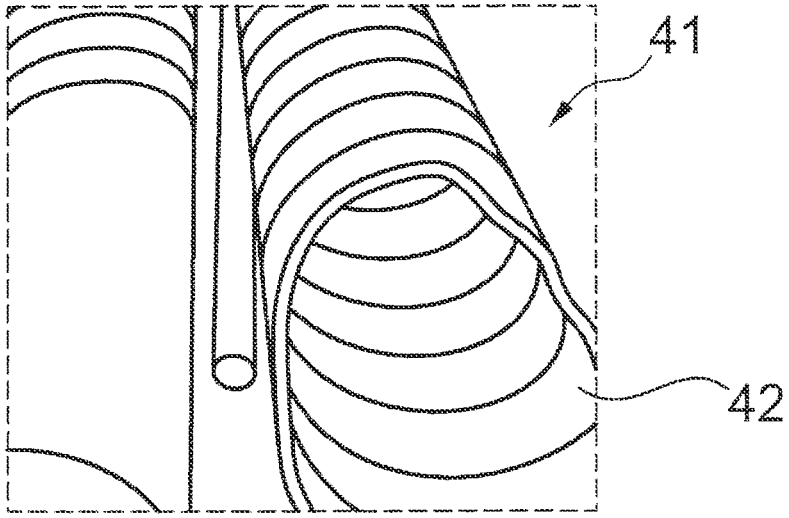
FIG. 12 is a perspective view of a pipe with inward extending swirl projections including gas engaging surfaces that are configured as a nozzle or a gas feed line to a nozzle for delivering gas into an incinerator.

FIG. 12 shows a further alternative arrangement of a swirl nozzle including a nozzle pipe 41. The exemplary nozzle pipe includes an inner surface which includes radially inward extending spiral gas engaging surface. The exemplary spiral gas engaging surface is operative to impart rotational flow to the gas which passes through the interior of the nozzle pipe as well as gas which exits therefrom through a nozzle outlet opening. Further in some exemplary arrangements the nozzle pipe 41 may be utilized as a feed line to a nozzle of the types previously discussed, or may be used as a delivery nozzle which provides rotational gas flow.

Of course it should be understood that the configurations shown are exemplary and the principles described herein may be utilized in other swirl nozzle configurations.

Thus the exemplary arrangements achieve improved operation, eliminate difficulties encountered in the use of prior devices and systems, and attain useful results that are described herein.

In the foregoing description certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful arrangements are not limited to the exact features that have been shown and described.

Further it should be understood that the features and/or relationships associated with one arrangement can be combined with the features and/or relationships from another arrangement. That is, various features and/or relationships from various arrangements described herein can be combined in further arrangements. The inventive scope of the disclosure is not limited only to the arrangements that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

We claim:

1. Apparatus comprising:
a swirl nozzle configured to deliver gas into an incinerator including:
a cylindrical pipe, wherein the pipe;
extends along an axis,
includes an inner surface that bounds an interior area of the pipe, wherein the inner surface is a continuous cylindrical surface, and
includes an outlet opening, wherein the outlet opening extends in a wall of a flue gas exhaust of the incinerator,
a swirl generator, wherein the swirl generator
is operative to cause gas that has been delivered from the outlet opening into the incinerator to flow rotationally relative to the axis,
wherein the swirl generator includes:
a plurality of identical vanes, wherein each of which vanes
have a vane length along the axial direction of 20 mm to 60 mm,
are uniformly angularly spaced from one another within the cylindrical pipe,
extend inwardly relative to the axis from the inner surface,
include an axially parallel straight inlet section and a curved outlet section,
wherein the outlet section is positioned axially closer to the outlet opening than the inlet section,
wherein the inlet section comprises 30% to 70% of the vane length.

2. The apparatus according to claim 1
wherein the swirl generator is disposed axially inward in the pipe from the outlet opening in the wall of the flue gas exhaust of the incinerator at least 5 mm.

3. The apparatus according to claim 1
wherein the inner surface has a diameter of from 40 mm to 80 mm.

4. The apparatus according to claim 1
wherein the curved outlet section of each vane extends at a swirl angle relative to the axially parallel straight inlet section of the respective vane,
wherein the swirl angle is from 15° to 60°.

5. The apparatus according to claim 1
wherein the swirl generator includes
at least four vanes,
wherein each of the vanes
includes at least a portion that is selectively angularly movable relative to a plane that extends through the axis.

6. The apparatus according to claim 1
wherein the swirl generator includes
at least four vanes,
wherein each of the vanes
has a cross-sectional thickness in a direction perpendicular to the axis of from 1 mm to 6 mm.

7. The apparatus according to claim 1
wherein the swirl generator includes
at least four vanes.

8. The apparatus according to claim 1
wherein the swirl generator includes
at least four vanes,
wherein each of the vanes
terminates radially inwardly at a vane inner surface that is disposed a radial distance away from the axis,
wherein a continuous open central gas flow passage extends along the axis between the vane inner surfaces.

9. The apparatus according to claim 1
wherein the gas is delivered from the outlet at a speed below Mach 0.4.

10. The apparatus according to claim 1
and further comprising:
a further swirl nozzle,
wherein the swirl nozzle and the further swirl nozzle
are arranged in side-by-side relation in the wall of the flue gas exhaust, and
are each operative to cause gas that has been delivered from the respective outlet openings of the swirl nozzles to flow in the flue gas exhaust in rotationally opposed directions.

11. The apparatus according to claim 1
wherein the outlet opening of the swirl nozzle delivers combustion gas into the flue gas exhaust,
and further comprising:
a blast nozzle, wherein the blast nozzle includes a blast nozzle outlet opening,
wherein the blast nozzle outlet opening extends in the wall of the flue gas exhaust and delivers combustion gas into the flue gas exhaust adjacent to the swirl nozzle outlet opening,
wherein the gas from the swirl nozzle outlet opening forms a gas curtain within the flue gas exhaust adjacent to the wall and the gas from the blast nozzle outlet opening diffuses in the flue gas exhaust away from the wall inwardly of the gas curtain.

12. The apparatus according to claim 11
wherein the wall of the flue gas exhaust wall comprises a front wall of the incinerator, wherein the flue gas exhaust includes a flue gas exhaust further wall,
wherein the further wall bounds the flue gas exhaust on an opposed side from the front wall,
and further including
a further blast nozzle, wherein the further blast nozzle delivers combustion gas into the flue gas exhaust through the further wall and in a direction opposed of delivery of gas from the blast nozzle,
wherein combustion gas is distributed across the entire flue gas exhaust.

13. The apparatus according to claim 1, wherein the outlet of the swirl nozzle delivers secondary combustion gas into the flue gas exhaust wherein the secondary combustion gas delivered from the outlet opening to flows rotationally relative to the axis and produces a gas curtain within the flue gas exhaust that extends sufficiently close to the wall to prevent carbon monoxide (CO) from breaking through the secondary combustion gas.

14. The apparatus according to claim 13
and further comprising:
a blast nozzle, wherein the blast nozzle includes a blast nozzle outlet opening, wherein the blast nozzle outlet opening extends in the wall of the flue gas exhaust and delivers secondary combustion gas in the flue gas exhaust adjacent to the swirl nozzle outlet opening, wherein the gas from the blast nozzle diffuses in the flue gas exhaust away from the wall beyond the gas curtain.

15. The apparatus according to claim 1
wherein the inner surface has a diameter of from 40 mm to 80 mm,
wherein gas is delivered from the outlet at a speed below Mach 0.4, and
wherein the nozzle is configured to deliver one or more of air and flue gas at a rate of from 100 to 1500 $Nm^3/h$.

16. The apparatus according to claim 1 wherein the swirl nozzle is operative to deliver combustion air into the flue gas exhaust of the waste incinerator,
wherein the swirl generator
is attached to the inner surface,
is operative to cause combustion air delivered from the outlet opening into the flue gas exhaust to flow rotationally relative to the axis and produce an air curtain close to the wall that prevents tendrils of carbon monoxide (CO) from breaking through the air curtain.

17. Apparatus comprising:
an incinerator, wherein the incinerator includes a flue gas exhaust that includes a flue gas exhaust wall,
a pair of swirl nozzles each configured to deliver gas into the flue gas exhaust,
wherein each respective swirl nozzle includes
a respective cylindrical pipe, wherein the pipe
extends along a respective axis,
includes a respective outlet opening in the flue gas exhaust wall,
includes a respective inner surface that bounds a respective interior area of the respective pipe,
at least one respective swirl projection, wherein the at least one swirl projection
is attached to the respective inner surface,
extends in the respective interior area,
is operative to cause gas that has been delivered from the respective outlet opening to flow rotationally relative to the axis,
wherein the respective outlet openings of the pair of swirl nozzles in the flue gas exhaust wall
are arranged in side-by-side relation,
are operative to cause gas that has been delivered from the respective outlet openings to flow in the flue gas exhaust in rotationally opposed directions.

18. The apparatus according to claim 17
wherein the at least one swirl projection
has at least one gas engaging surface thereon, wherein the at least one gas engaging surface extends at a swirl angle relative to a plane that includes the axis,
wherein the swirl angle is from 15° to 60°.

19. The apparatus according to claim 17
wherein the at least one swirl projection includes at least four vanes,
wherein each of the vanes
is angularly disposed from each of the other vanes,
extends radially inward from the inner surface,
terminates radially inwardly at a vane inner surface that is disposed a radial distance away from the axis,
wherein a continuous open central gas flow passage extends along the axis between the vane inner surfaces.

20. The apparatus according to claim 17
wherein the at least one swirl projection includes at least four vanes,
wherein each of the vanes
is angularly disposed from each of the other vanes,
extends radially inward from the inner surface,
terminates radially inwardly at a vane inner surface that is disposed a radial distance away from the axis,
has an axial length along the axial direction,
includes a straight section, wherein the straight section is disposed furthest away from the respective outlet opening,
is comprised of from 30% to 70% of the axial length,
wherein in the straight portion the vane extends parallel to the axis and is not curved,
wherein a continuous open central gas flow passage extends along the axis between the vane inner surfaces along the entire axial length.

* * * * *